United States Patent [19]

Kameoka et al.

[11] Patent Number: 4,737,452

[45] Date of Patent: Apr. 12, 1988

[54] SILVER HALIDE PHOTOGRAPHIC MATERIALS

[75] Inventors: Kimitaka Kameoka; Nobuaki Inoue; Yoshio Inagaki; Hidetoshi Kobayashi; Toshiro Takahashi, all of Kanagawa, Japan

[73] Assignee: Fuji Photo Film Co., Ltd., Kanagawa, Japan

[21] Appl. No.: 930,068

[22] Filed: Nov. 12, 1986

Related U.S. Application Data

[63] Continuation of Ser. No. 707,101, Feb. 28, 1985, abandoned.

[30] Foreign Application Priority Data

Feb. 28, 1984 [JP] Japan ..... 59-36788

[51] Int. Cl.[4] ..... G03C 1/10

[52] U.S. Cl. ..... 430/600; 430/264; 430/603; 430/611; 430/949

[58] Field of Search ..... 430/603, 611, 949, 264, 430/600

[56] References Cited

U.S. PATENT DOCUMENTS

| | | | |
|---|---|---|---|
| 4,243,739 | 1/1981 | Mifune et al. | 430/949 |
| 4,332,878 | 6/1982 | Akimura et al. | 430/264 |
| 4,447,522 | 5/1984 | Hirano et al. | 430/949 |

*Primary Examiner*—Won H. Louie

*Attorney, Agent, or Firm*—Sughrue, Mion, Zinn, Macpeak, and Seas

[57] ABSTRACT

A silver halide photographic material comprising a support having at least one silver halide emulsion layer containing substantially surface latent image type silver halide grains, said emulsion layer or at least one hydrophilic colloid layer adjacent to the emulsion layer containing a compound represented by general formula (III):

(III)

wherein $L_2$ represents —CONR—, —$SO_2$NR— or —NRCONR′ and Z, $L_1$, m, Ro, $R_1$ and M are as herein described. The silver halide photographic material is capable of having high contrast negative images, high sensitive negative images, and good dot images.

12 Claims, No Drawings

SILVER HALIDE PHOTOGRAPHIC MATERIALS

This application is a continuation of application Ser. No. 707,101 filed Feb. 28, 1985, now abandoned.

FIELD OF THE INVENTION

This invention relates to a silver halide photographic material and more particularly to a silver halide photographic material capable of giving high contrast negative images, high sensitive negative images, and good dot images.

BACKGROUND OF THE INVENTION

It is known to add a hydrazine compound to silver halide photographic emulsions or developers. For example, U.S. Pat. No. 3,730,727 describes a developer containing ascorbic acid and hydrazine, U.S. Pat. No. 3,227,552 describes the use of hydrazine as an auxiliary developing agent for obtaining direct positive color images, U.S. Pat. No. 3,386,831 describes a silver halide photographic material containing the β-monophenylhydrazide of an aliphatic carboxylic acid as a stabilizer. These techniques are also described in U.S. Pat. No. 2,419,975 and Mees, *The Theory of Photographic Process*, 3rd Ed., p. 281 (1966).

In particular, U.S. Pat. No. 2,419,975 discloses that high contrast negative images are obtained by the addition of a hydrazine compound.

It is also described in the foregoing patent that by developing a silver halide photographic material containing a hydrazine compound in the silver chlorobromide emulsion layer thereof with a developer having a high pH of 12.8, very high contrast photographic characteristics having a gamma of over 10 are obtained. However, a high alkaline developer having a pH near 13 is unstable and liable to be air-oxidized, and cannot be stored or used for a long period of time.

The high contrast photographic characteristics having a gamma of over 10 are very useful for the photographic reproduction of continuous tone images by dot image, which is useful for making printing plates, or the reproduction of line images. For obtaining such high contrast photographic characteristics, a method of developing a silver halide photographic material using a silver chlorobromide photographic emulsion containing more than 50 mol%, preferably more than 75 mol% silver chloride with a hydroquinone-containing developer having a very low effective concentration of a sulfite ion (usually lower than 0.1 mol/liter) has been conventionally used. However, in the method, the sulfide ion concentration in the developer is low and hence the developer is very unstable and cannot be stored longer than 3 days.

Moreover, since these methods require the use of a silver chlorobromide emulsion having a relatively high content of silver chloride, a high sensitivity can not be obtained in these methods. Accordingly, it has been greatly desired to obtain super high contrast photographic characteristics useful for the reproduction of dot images and line images using high sensitive silver halide emulsions and a stable developer.

The inventors previously disclosed silver halide photographic emulsions giving very high contrast negative photographic characteristics using stable developers in U.S. Pat. Nos. 4,224,401, 4,168,977, 4,243,739, 4,272,614, and 4,323,643. However, it has now been found that the acylhydrazine compounds used in these inventions have various disadvantages.

That is, it is known that hydrazines generate nitrogen gas during development and it sometimes happens that the nitrogen gas gathers in the photographic films during development to form bubbles therein and spoil the photographic images.

Thus, from the aspect of reducing the generation of the bubbles and reducing, at the same time, the cost for producing photographic images, a compound capable of giving very high contrast photographic characteristics with a small amount of the compound has been desired.

Also, in these conventional hydrazines, a large amount thereof is required for obtaining a high sensitivity and high contrast and in the case of requiring a particularly high sensitivity for the performance of photographic materials, it is desirable to use the hydrazines with other sensitizing techniques (for example, strengthening the chemical sensitization, the increase of silver halide grain size, and the addition of the compounds accelerating sensitivity, as described in U.S. Pat. Nos. 4,272,606 and 4,241,164, etc.), but the use of the sensitizing technique with the hydrazines sometimes cause an increase in sensitivity with the passage of time and an increase of fog during storage. Accordingly, a compound which is effective for the foregoing purpose with a very small amount thereof without causing problems in stability with the passage of time and which can be easily prepared has been desired.

On the other hand, it is described in U.S. Pat. Nos. 4,385,108 and 4,269,929 that very high contrast negative photographic characteristics are obtained by using hydrazines having a substituent capable of being easily adsorbed on silver halide grains, but in practical use of the hydrazine compounds having the foregoing substituent described in the above patent specifications, there is a problem that they cause desensitization with the passage of time during the storage of the photographic materials containing them. Accordingly, it is necessary to select a compound which does not cause such a problem.

SUMMARY OF THE INVENTION

A first object of this invention is, therefore, to provide a silver halide photographic material capable of providing very high contrast negative-gradation photographic characteristics having gamma of over 10 using a stable developer.

A second object of this invention is to provide a negative type silver halide photographic material containing an acylhydrazine capable of giving desired very high contrast negative gradation photographic characteristics with a small addition amount thereof without causing bad influences on the photographic properties.

A third object of this invention is to provide a negative type silver halide photographic material having excellent stability with the passage of time containing an acylhydrazine which can be easily prepared and has an excellent shelf life.

It has been discovered that the above-described objects of this invention can be attained by incorporating a mercapto compound represented by the following general formula (I) in a substantially surface latent image type silver halide photographic emulsion layer or at least one hydrophilic colloid layer adjacent to the emulsion layer:

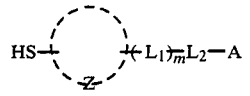

(I)

wherein Z represents an atomic group necessary for forming a monocyclic or condensed heterocyclic ring composed of a carbon atom or carbon atoms and a nitrogen atom or nitrogen atoms; $L_1$ represents a divalent organic group; m represents 0 or 1; $L_2$ represents —CONR—, —NRCO—, —$SO_2$NR—, —NR$SO_2$—, —OCO—, —COO—, —S—, —NR—, —CO—, —SO—, —$SO_2$—, —OCOO—, —NRCONR'—, —NRCOO—, —OCONR—, or —NR$SO_2$NR'— (wherein R and R' each represents a hydrogen atom, an alkyl group or an aryl group); and A represents a residue formed by removing one hydrogen atom from Ar of the compound represented by the following general formula (II) or a residue formed by removing M from the compound of general formula (II):

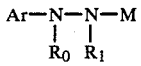

(II)

wherein Ar represents an aryl group; M represents a formyl group, an acyl group, an alkylsulfonyl group, an arylsulfonyl group, an alkylsulfinyl group, an arylsulfinyl group, a carbamoyl group, a sulfamoyl group, an alkoxycarbonyl group, an aryloxycarbonyl group, a sulfinamoyl group, an alkoxysulfonyl group, a thioacyl group, a thiocarbamoyl group, or a heterocyclic group; $R_1$ represents a hydrogen atom; said M, $R_1$ and the nitrogen atom to which M and $R_1$ attach may form a partial structure

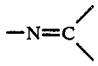

of hydrazone; and $R_0$ represents a hydrogen atom, a formyl group, an acyl group, an alkoxycarbonyl group or an aryloxycarbonyl group.

DETAILED DESCRIPTION OF THE INVENTION

Among the compounds represented by general formula (I), the compounds shown by the following general formulae (III) and (IV) are preferred.

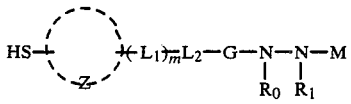

(III)

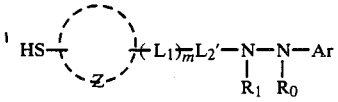

(IV)

wherein Z, $L_1$, $L_2$, m, $R_0$, $R_1$, M and Ar have the same significance as defined above; and in general formula (III), G represents a group formed by removing one hydrogen atom from Ar of general formula (II) (i.e., an arylene group); and in general formula (IV), $L_2'$ represents —CO—, —SO—, or —$SO_2$— in the divalent groups defined by $L_2$ of general formula (I).

The heterocyclic ring formed by Z in general formula (I), (III) or (IV) may be further substituted by an optional substituent in addition to a mercapto group and $-(L_1)-_m$, is composed of a 5- to 7-membered ring, and may form a condensed ring with another heterocyclic ring or a benzene ring. Also, the mercapto group bonded to the heterocyclic ring shown by Z may form the following thion structure by tautomerizm as shown below:

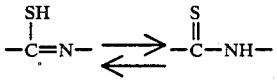

Examples of the heterocyclic ring formed by Z are pyrrole, pyrazole, imidazole, triazole, tetrazole, pyridine, pyrimidine, pyrazine, pyridazine, triazine, indazole, benzimidazole, azaindene, etc., and preferably triazole, tetrazole, imidazole and benzimidazole.

$L_1$ in general formula (I), (III) or (IV) is a divalent organic group and is composed of the divalent groups such as an alkylene group, an alkenylene group, a phenylene group, —O—, —S—, —CO—, —SO—, —$SO_2$—, an imino group, etc., solely or in combination. Specific examples of the divalent organic group are as follows:

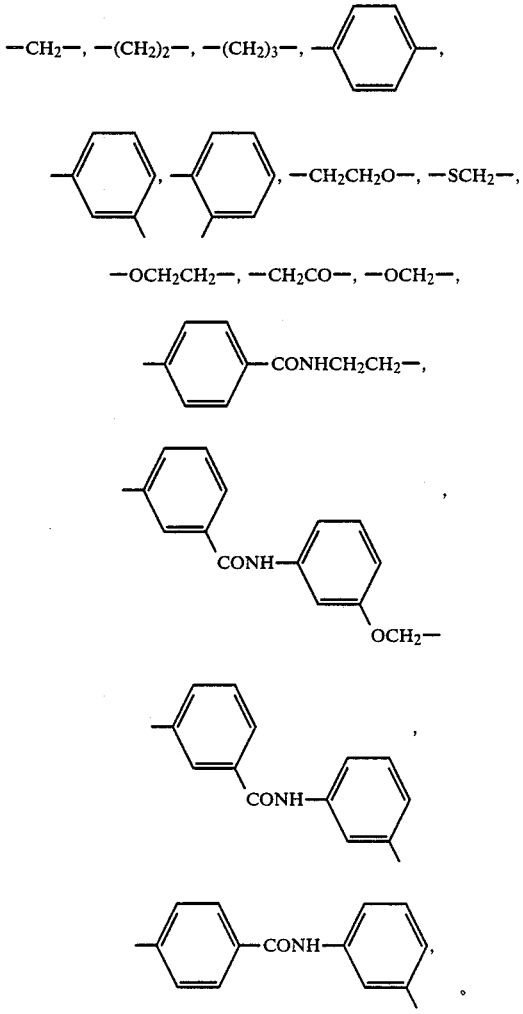

-continued

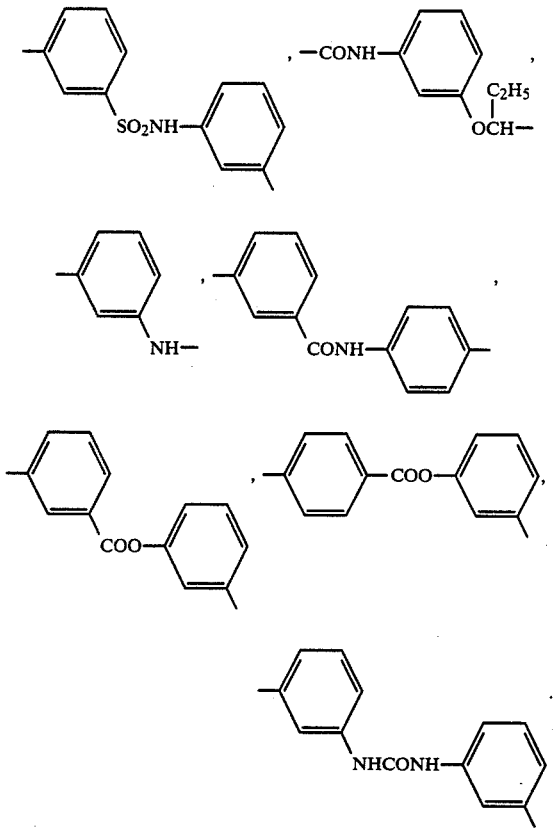

Particularly preferred $L_1$ is $-(CH_2)-_2$ or $-(CH_2)-_3$.

$L_2$ in general formula (I) or (III) is preferably —CONR—, —$SO_2$NR— or —NRCONR'—, and more preferably —CONR—. R and R' in $L_2$ are each a hydrogen atom, an alkyl group (preferably a lower alkyl group such as a methyl group, an ethyl group, etc.), or an aryl group (preferably a phenyl group) and these groups may have a substituent. R and R' are particularly preferably hydrogen atoms.

$L_2'$ represents —CO—, —SO— or —$SO_2$— in the divalent group defined by $L_2$ of general formula (I). It is most preferred that $L_2'$ in general formula (IV) be —CO—.

The aryl group represented by Ar in general formula (II) or (IV) is preferably a phenyl group or a naphthyl group and G in general formula (III) is an arylene group formed by removing one hydrogen atom from the aryl group Ar. The aryl group shown by Ar and the arylene group shown by G may have one or more substituents. Examples of the substituent are an alkyl group (e.g., a methyl group, an ethyl group, etc.), a halogen atom (e.g., a chlorine atom, a bromine atom, etc.), an alkoxy group (e.g., a methoxy group, a methoxyethoxy group, etc.), a carbonamido group (e.g., an acetamido group, etc.), and a sulfonamido group (e.g., a methanesulfonamido group, etc.).

$R_0$ in general formula (II), (III) or (VI) is preferably a hydrogen atom, a formyl group, an acyl group (e.g., an acetyl group, a propionyl group, a trifluoroacetyl group, a chloroacetyl group, a benzoyl group, a 4-chlorobenzoyl group, a pyruvoyl group, a methoxalyl group, a methyloxamoyl group, etc.), an alkoxycarbonyl group (e.g., a methoxycarbonyl group, an ethoxycarbonyl group, etc.), or an aryloxycarbonyl group (e.g., a phenoxycarbonyl group, a 4-methylphenoxycarbonyl group, an α-naphthoxycarbonyl group, etc.), etc.

$R_0$ is most preferably a hydrogen atom.

M in general formula (II) or (III) is a formyl group, an acyl group (e.g., an acetyl group, a propionyl group, a trifluoroacetyl group, a chloroacetyl group, a benzoyl group, a 4-chlorobenzoyl group, a pyruvoyl group, a methoxalyl group, a methyloxamoyl group, etc.), an alkylsulfonyl group (e.g., a methanesulfonyl group, a 2-chloroethanesulfonyl group, etc.), an arylsulfonyl group (e.g., a benzenesulfonyl group, etc.), an alkylsulfinyl group (e.g., a methanesulfinyl group, etc.), an arylsulfinyl group (e.g., a benzenesulfinyl group, etc.), a carbamoyl group (e.g., a methylcarbamoyl group, a phenylcarbamoyl group, etc.), a sulfamoyl group (e.g., a dimethylsulfamoyl group, etc.), an alkoxycarbonyl group (e.g., a methoxycarbonyl group, a methoxyethoxycarbonyl group, etc.), an aryloxycarbonyl group (e.g., a phenoxycarbonyl group, etc.), a sulfinamoyl group (e.g., a methylsulfinamoyl group, etc.), an alkoxysulfonyl group (e.g., a methoxysulfonyl group, an ethoxysulfonyl group, etc.), a thioacyl group (e.g., a methylthiocarbonyl group, etc.), a thiocarbamoyl group (e.g., a methylthiocarbamoyl group, etc.), or a heterocyclic group (e.g., a pyridine ring group, etc.).

The groups shown by M and $R_0$ are not limited to the practical examples shown above and, for example, the above-described groups may have a substituent.

M is preferably a formyl group or an acyl group and more particularly a formyl group.

$R_1$ in the general formula (II) or (III) is a hydrogen atom or forms a partial structure

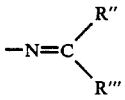

of hydrazone with M and the nitrogen atom to which $R_1$ and M attach.

$R_1$ in the general formula (IV) is a hydrogen atom or forms a partial structure

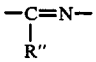

of hydrazone with $L_2'$ and the nitrogen atom to which $R_1$ and $L_2'$ attach.

In the above formulae, R'' represents an alkyl group (e.g., methyl, ethyl, etc.), an aryl group (e.g., phenyl, etc.), or a heterocyclic group (e.g., pyridyl, thiazolyl, etc.), and R''' represents a hydrogen atom, an alkyl group (e.g., methyl, ethyl, etc.), an aryl group (e.g., phenyl, etc.), or a heterocyclic group (e.g., pyridyl, thiazolyl, etc.).

Examples of hydrazone formed by $R_1$ and M or $L_2'$ are acetonehydrazone, benzaldehydehydrazone, o-hydroxybenzaldehydehydrazone, etc.

$R_1$ is particularly preferably a hydrogen atom.

The particularly preferred compounds in the compounds shown by general formulae (I), (III) and (IV) are those shown by the following general formula (V):

(V)

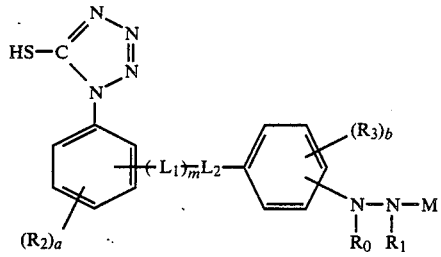

wherein $R_2$ and $R_3$ each, independently, represents a hydrogen atom, an alkyl group (e.g., a methyl group, an ethyl group, etc.), an alkoxy group (e.g., a methoxy group, a methoxyethoxy group, etc.), a carbonamido group (e.g., an acetamido group, etc.), a sulfonamido group (e.g., a methanesulfonamido group, a benzenesulfonamido group, etc.) or a halogen atom (e.g., a chlorine atom, a bromine atom, etc.). The foregoing groups may have one or more substituents. a and b are 0 ot 4.

Particularly preferred $R_2$ and $R_3$ is a hydrogen atom, an alkoxy group or a sulfonamido group.

Also, in the above formula, $L_1$, m, $L_2$, $R_0$, $R_1$ and M have the same significance as defined above.

$L_2$ in general formula (V) is preferably —CONR—, —$SO_2$NR—, —NRCONR′—, etc., and more preferably —CONR—. R and R′ are as defined for $L_2$ in the general formulae (I) and (III).

Examples of the compounds for use in this invention are illustrated below.

1.

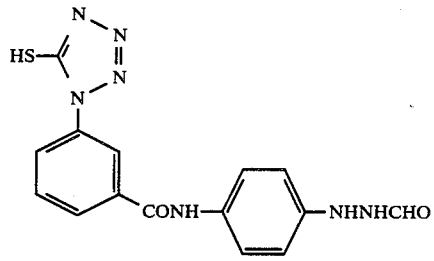

2.

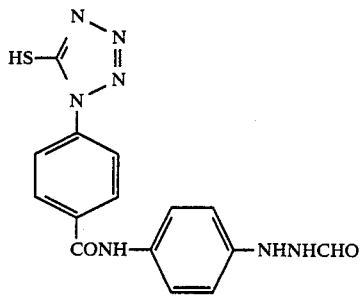

3.

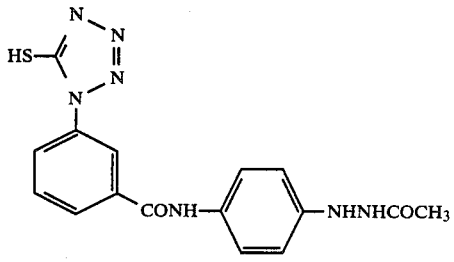

4.

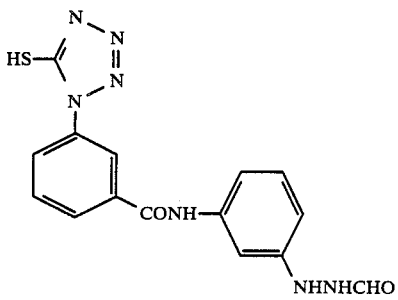

5.

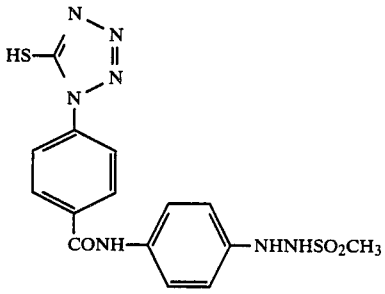

6.

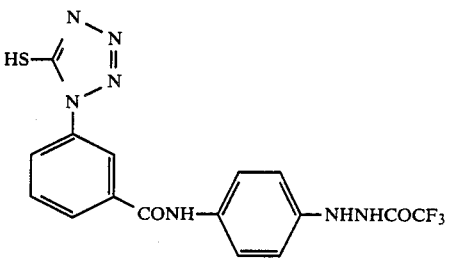

7.

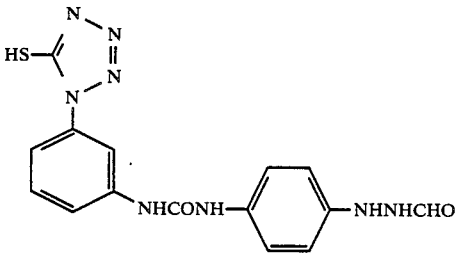

8.

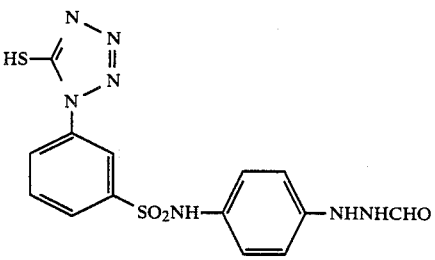

-continued
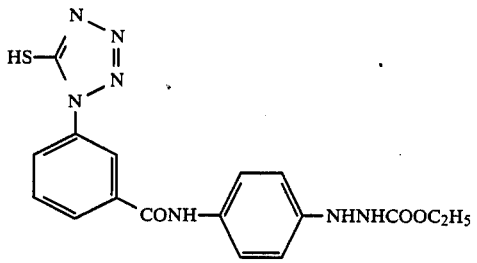
9.
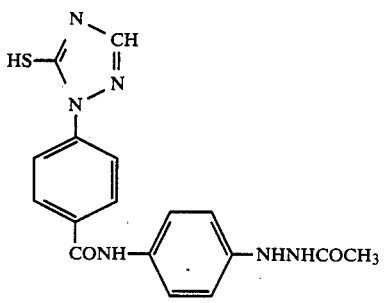
10.
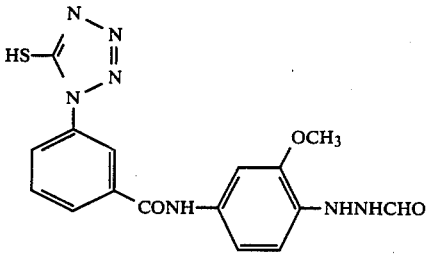
11.
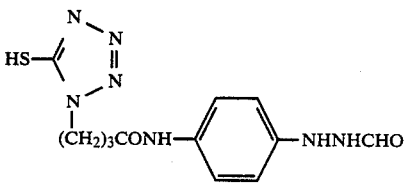
12.
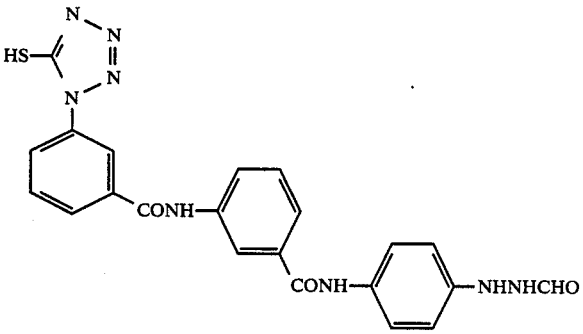
13.
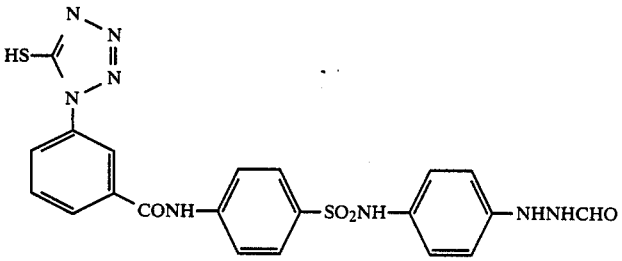
14.
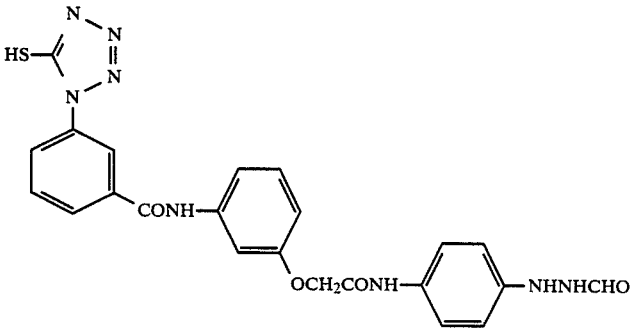
15.

-continued
16.
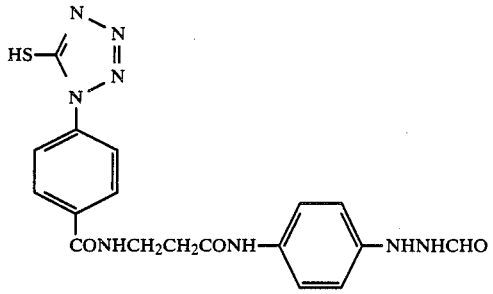
17.
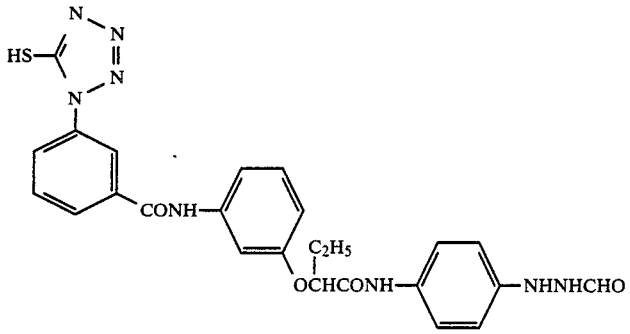
18.
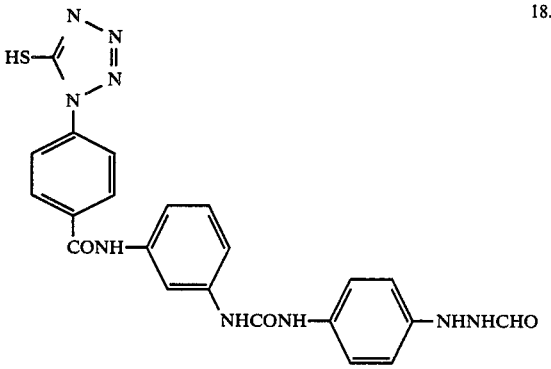
19.
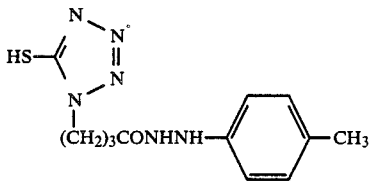
20.
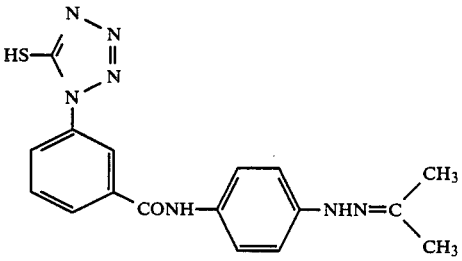
21.
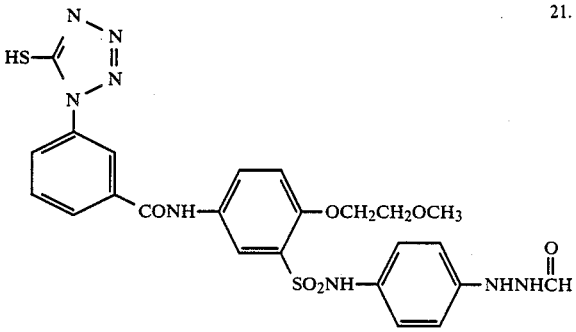
22.
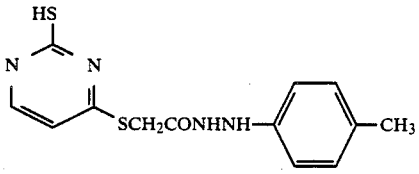
23.
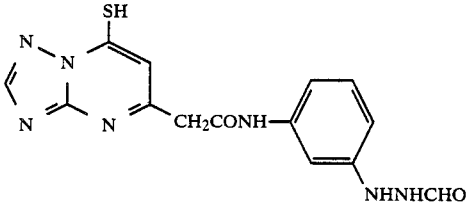

-continued

24.

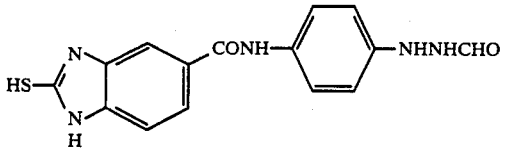

25.

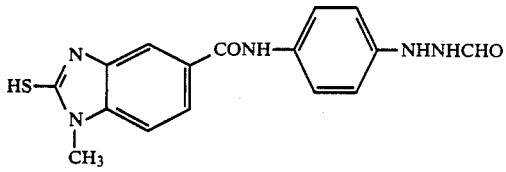

26.

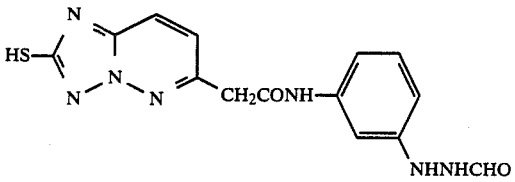

27.

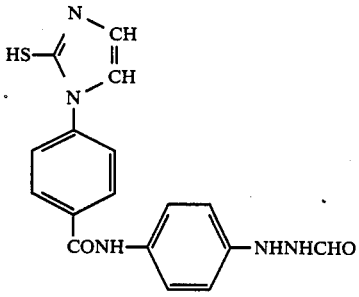

28.

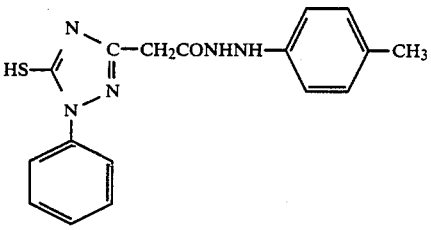

29.

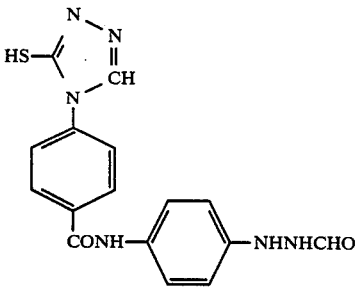

The compounds for use in this invention described above can be prepared by various methods. For example, the compound of general formula (III) wherein $L_2$ is —CONH— is produced as follows:

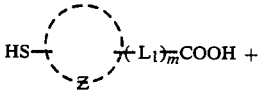

(A)

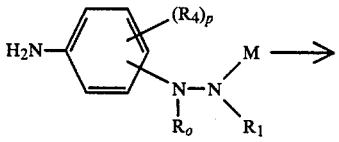

(B)

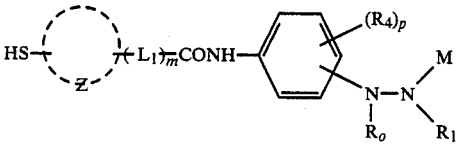

wherein Z, $L_1$, m, $R_0$, $R_1$ and M have the same significance as defined above, and $R_4$ and p represent the same significance as defined for $R_3$ and b in the general formula (V) above, respectively.

The compound of general formula (IV) wherein $L_2'$ is —CO— is produced as follows:

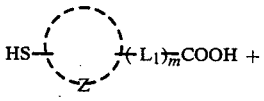

(C)

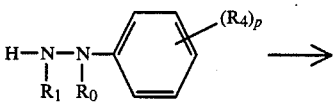

(D)

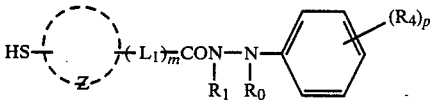

wherein Z, $L_1$, m, $R_0$ and $R_1$ have the same significance as defined above and $R_4$ and p present the same significance as defined for $R_3$ and b in the general formula (V) above, respectively.

The above-described condensation reaction can be performed in a solvent such as acetonitrile, tetrahydrofuran, dioxane, methylene chloride, chloroform, dimethylformamide, dimethylacetamide, etc., using a condensing agent such as dicyclohexylcarbodiimide, carbonyldiimidazole, etc. In this case, a catalyst such as N,N-dimethylaminopyridine, pyrrolidinopyridine, N-hydroxybenzotriazole, etc., and a base such as triethylamine, N-ethylpiperidine, N-ethylmorpholine, pyridine, etc., may be used in the reaction for improving the yield, shortening the reaction time, etc.

In a method other than the above reactions, the desired compound can also be obtained by first converting compound (A) or (C) into a mixed acid anhydride with a chloroformic acid ester such as ethyl chloroformate isobutyl chloroformate, etc., in a solvent such as dimethylformamide, dimethylacetamide, etc., in the presence of a base such as pyridine, tirethylamine, etc., and then performing the condensation reaction of the mixed acid anhydride with aniline compound (B) or hydrazine compound (D). The method of producing aniline compound (B) is described in detail in Japanese Patent Application (OPI) No. 74729/79 (the term "OPI" as used herein refers to a "published unexamined Japanese patent application").

Now, the synthesis methods of the compounds for use in this invention are practically explained by the following synthesis examples.

SYNTHESIS EXAMPLE 1

Synthesis of Compound 1

In 500 ml of toluene was dissolved 82.5 g of ethyl m-aminobenzoate. While stirring the solution at room temperature, 83.4 g of N,N-diethylthiocarbamoyl chloride was added dropwise to the solution over a period of about 1 hour and then the mixture was refluxed for 5 hours. The toluene was distilled off under reduced pressure, the residue thus formed was dissolved in 300 ml of ethyl acetate, and the ethyl acetate solution was washed with water. Then, ethyl acetate was distilled off under reduced pressure and the residue was further subjected to distillation under reduced pressure to provide 80 g of oily ethyl m-isothiocyanatobenzoate having a boiling point of 125° C./0.6 mm Hg at a yield of 77%.

To a mixture of 69 g of ethyl m-isothiocyanatobenzoate and 26 g of sodium azide was added 500 ml of water and the mixture was refluxed for 2 hours. After removing deposited insoluble matter by filtration, the filtrate was acidified by the addition of concentrated hydrochloric acid (pH about 2), and crystals of 1-(3-ethoxycarbonylphenyl)-5-mercaptotetrazole thus deposited were collected by filtration, mixed with 30 g of sodium hydroxide and 300 ml of water, and the mixture was stirred for 30 minutes at 70° C. The reaction mixture was neutralized by concentrated hydrochloric acid and crystals thus deposited were collected by filtration. The crude crystals were recrystallized from methanol to provide 32 g of 1-(3-carboxyphenyl)-5-mercaptotetrazole. The yield was 42% and the mleting point of the product was 181°-182° C.

Then, according to the method described in Japanese Patent Application (OPI) No. 74729/79, 1-formyl-2-(4-aminophenyl)hydrazine was produced. That is, to 1.6 liters of acetonitrile was added 45 g of 4-nitrophenylhydrazine and then 322 g of formic acid was gradually added to the mixture with stirring, whereby a homogeneous solution was obtained. After 20 minutes, crystals began to deposit. After further performing the reaction for 2 hours at an inside temperature of 80° C., the reaction mixture was cooled and crystals thus formed were collected by filtration, washed with acetonitrile and dried to provide 495 g of 1-formyl-2-(4-nitrophenyl)hydrazine having a melting point of 184°-186° C.

Then, 30 g of 1-formyl-2-(4-nitrophenyl)hydrazine was catalytically reduced in 1.6 liters of ethanol at room temperature using palladium-carbon as a catalyst. The reaction mixture was filtered to remove the catalyst and the filtrate was evaporated to dryness to provide 20.5 g of 1-formyl-2-(4-aminophenyl)hydrazine having a melting point of 123°-125° C. as a light brown solid.

Then, 11.1 g of 1-(3-carboxyphenyl)-5-mercaptotetrazole and 7.6 g of 1-formyl-2-(4-aminophenyl)hydrazine were dissolved in 50 ml of dimethylformamide and a solution of 10.3 g of dicyclocarbodiimide in 5 ml of dimethylformamide was added dropwise to the solution with stirring at 0° C. under a nitrogen atmosphere over a period of 15 minutes. Thereafter, the mixture was stirred for 1 hour and for 2 hours at 25° C. Dicyclohexylurea formed was removed by filtration and the filtrate was added to 1.5 liters of ice water. Crude crystals thus deposited were collected by filtration and dispersed in 100 ml of methanol under heating for 15 minutes. The reaction mixture was cooled to room temperature and filtered to provide 9.6 g of desired Compound 1. The yield was 54% and the melting point was 198°-200° C.

SYNTHESIS EXAMPLE 2

Synthesis of Compound 2

In 500 ml of toluene was dissolved 82.5 g of ethyl p-aminobenzoate and after adding thereto 83.4 g of N,N-diethylthiocarbamoyl chloride, the mixture was refluxed for 8 hours. After ice cooling the reaction mixture, 100 ml of concentrated hydrochloric acid was added to the mixture and the toluene layer thus formed was collected and washed with water. After distilling off toluene under reduced pressure, the oily material thus formed was crystallized from methanol to provide 77.1 g of ethyl p-isothiocyanatobenzoate. The yield was 74.5% and the melting point was 52° C.

Then, 31 g of ethyl p-isothiocyanatobenzoate and 11.7 g of sodium azide were dispersed in 300 ml of water and the dispersion was refluxed for 5 hours. The reaction mixture was cooled to room temperature and acidified (pH about 2) by the addition of concentrated hydrochloric acid. Crystals of 1-(4-ethoxycarbonylphenyl)-5-mercaptotetrazole thus deposited were collected by filtration and after adding thereto 25 g of sodium hydroxide and 500 ml of water, the mixture was stirred for 30 minutes at 70° C. The reaction mixture was cooled to room temperature, neutralized by the addition of concentrated hydrochloric acid, and crystals thus deposited were collected by filtration and recrystallized from methanol to provide 40 g of 1-(4-carboxyphenyl)-5-mercaptotetrazole. The yield was 48% and the melting point was 198° C.

By following the same procedure as in Synthesis Example 1 using 11.1 g of 1-(4-carboxyphenyl)-5-mercaptotetrazole and 7.6 g of 1-formyl-2-(4-aminophenyl)hydrazine, 8.0 g of desired Compound 2 was obtained. The yield was 45% and the melting point was 190°-196° C.

SYNTHESIS EXAMPLE 3

Synthesis of Compound 3

In 100 ml of acetonitrile were dissolved 15.3 g of p-nitrophenylhydrazine and 10.1 g of triethylamine, and 7.9 g of acetyl chloride was added dropwise to the solution under ice-cooling over a period of 15 minutes. Thereafter, the mixture was stirred for 1 hour at 25° C., 100 ml of water was added therreto, and crystals thus deposited were collected by filtration and washed with acetonitrile to provide 16.6 g of 1-acetyl-2-(4-nitrophenyl)hydrazine. The melting point was 209°-214° C.

Then, 16.6 g of 1-acetyl-2-(4-nitrophenyl)hydrazine was catalytically reduced in 800 ml of ethanol at room temperature using palladium-carbon as a catalyst. The reaction mixture was filtered and cooled to provide 10.5 g of 1-acetyl-2-(4-aminophenyl)hydrazine. The yield was 75% and the melting point was 130°-140° C.

In 20 ml of dimethylformamide were dissolved 4.4 g of 1-(3-carboxyphenyl)-5-mercaptotetrazole and 3.3 g of 1-acetyl-2-(4-aminophenyl)hydrazine and then a solution of 4.1 g of dicyclohexylcarbodiimide in 5 ml of dimethylformamide was added dropwise to the solution with stirring at 0° C. in a nitrogen atmosphere over a period of 15 minutes. Thereafter, the mixture was stirred for 2 hours and further for 4 hours at 25° C. After removing dicyclohexylurea thus formed by filtration, the filtrate was added to 1 liter of ice water. Crude crystals were collected by filtration and then purified by silica gel column chromatography using a mixture of chloroform and ethanol as a development solvent to provide 3.5 g of desired Compound 3. The yield was 48% and the melting point was 178°-182° C.

SYNTHESIS EXAMPLE 4

Synthesis of Compound 13

In 500 ml of acetonitrile were dissolved 68.2 g of 1-formyl-2-(4-aminophenyl)hydrazine and 60 ml of triethylamine, and 70 g of 3-nitrobenzoyl chloride was added dropwise to the solution with stirring while maintaining the inside temperature below 50° C., whereby crystals deposited.

Furthermore, after heating to 60° C. for 2 hours, the reaction mixture was cooled, poured in water, and crystals thus formed were collected by filtration and recrystallized from ethanol to provide 72.8 g of 1-formyl-2-[4-(3-nitrobenzamido)phenyl]hydrazine. The yield was 54% and the melting point was 185°-187° C.

A mixture of 800 ml of isopropanol, 80 ml of water, a small amount of ammonium chloride, and 12 g of 1-formyl-2-[4-(3-nitrobenzamido)phenyl]hydrazide was stirred under heating on a steam bath. Then, 80 g of iron powder was added to the mixture and the resultant mixture was refluxed for 1 hour. The reaction mixture was filtered, the filtrate was concentrated to about 200 ml under reduced pressure and cooled to room temperature. Crystals thus deposited were collected by filtration to provide 8.0 g of 1-formyl-2-[4-(3-aminobenzamido)phenyl]hydrazine. The yield was 74% and the melting point was 177°-178° C.

By following the same procedure as Synthesis Example 1 using 4.4 g of 1-(3-carboxyphenyl)-5-mercaptotetrazole and 5.4 g of 1-formyl-2-[4-(3-aminobenzamido)-phenyl]hydrazine, 5.3 g of desired Compound 13 was obtained. The yield was 56% and the melting point was 168°-174° C.

SYNTHESIS EXAMPLE 5

Synthesis of Compound 19

In 100 ml of chloroform was dissolved 13 g of ethyl 4-aminobutanoate. 20.2 g of triethylamine, 7.6 g of carbon disulfide, and 10.8 g of ethyl chlorocarbonate were successively added dropwise to the solution with stirring at 0° C. Thereafter, the mixture was stirred for 1 hour at room temperature and then for 1 hour at 50° C. After washing the reaction mixture with water, chloroform was distilled off, the residue was mixed with 10 g of sodium azide and 100 ml of water, and the mixture was refluxed for 5 hours with vigorous stirring. After cooling the reaction mixture to room temperature, 16.8 g of potassium hydroxide was added to the reaction mixture and the resultant mixture was stirred for 1 hour. The reaction mixture thus obtained was acidified with the addition of hydrochloric acid and crystals thus deposited were collected by filtration to provide 13.9 g of 1-(3-carboxypropyl)-5-mercaptotetrazole. The yield was 74% and the melting point was 90°-95° C.

In 50 ml of dimethylformamide were dissolved 9.4 g of 1-(3-carboxypropyl)-5-mercaptotetrazole and 6.1 g of p-tolylhydrazine, and a solution of 10.3 g of dicyclohexylcarbodiimide in 20 ml of dimethylformamide was added dropwise to the solution over a period of 30 minutes with stirring at 0° C. under a nitrogen atmosphere. After stirring the mixture for 5 hours at room temperature, the reaction mixture was added to 1 liter of ice water. Crude crystals thus deposited were collected and recrystallized from methanol to provide 6.4 g of desired Compound 19. The yield was 44% and the melting point was 112°-114° C.

SYNTHESIS EXAMPLE 6

Synthesis of Compound 25

To 1.9 g of 5-carboxy-2-mercaptobenzimidazole were added 25 ml of N,N-dimethylformamide and 2.55 ml of pyridine and the mixture was cooled to −15° C. Then, 1.76 g of benzenesulfonyl chloride was added dropwise to the mixture while maintaining the temperature of the mixture below −5° C. and the resultant mixture was stirred for 10 minutes.

After cooling the mixture to −15° C., a solution of 1.51 g of 1-formyl-2-(4-aminophenyl)hydrazine in 10 ml of N,N-dimethylformamide was added dropwise to the mixture while maintaining the temperature of the mixture below −5° C. The mixture was stirred for 20 minutes and then for 1 hour at room temperature.

Then, 50 ml of acetonitrile was added to the reaction mixture and crystals thus formed were collected by filtration and washed with acetonitrile. The crystals thus obtained were dissolved in 100 ml of N,N-dimethylformamide and activated carbon was added to the solution. After removing insoluble matter by filtration, the filtrate was added to 150 ml of acetontrile and the precipitate thus formed was collected by filtration, washed with acetonitrile, and dried to provide 0.57 g of desired Compound 25. The yield was 17.8% and the melting point was 195° C. (decompd.).

SYNTHESIS EXAMPLE 7

Synthesis of Compound 27

In 25 ml of N,N-dimethylacetamide was dissolved 3.3 g of 3-(4-carboxyphenyl)-2-mercaptoimidazole and the solution was cooled to −10° C. While maintaining the temperature of the system below −5° C., 1.95 ml of isobutyl chloroformate and then 2.1 ml of triethylamine were added to the solution and the mixture was stirred for 10 minutes at −5° C. Then, a solution of 2.26 g of 1-formyl-2-(4-aminophenyl)hydrazine in 15 ml of N,N-dimethylacetamide was added to the mixture at −3° C. to −10° C. and after stirring the mixture for 10 minutes, the temperature was increased to room temperature over a period of 3 hours. Then, the reaction mixture was poured in 200 ml of an aqueous solution of 2% sodium hydrogencarbonate and the precipitate thus formed was collected by filtration and washed with water and then methanol, and dried to provide 0.8 g of desired Compound 27. The yield was 15% and the melting point was 235° C. (decompd.).

SYNTHESIS EXAMPLE 8

Synthesis of Compound 29

A mixture of 5.0 g of hydrazine hydrate and 20 ml of N,N-dimethylacetamide was ice cooled below 5° C. under a nitrogen atmosphere. To the mixture was added dropwise a solution of 20.7 g of 4-carboethoxyphenyl isothiocyanate in 60 ml of N,N-dimethylacetamide and then the mixture was stirred for 1 hour at room temperature. The reaction mixture was poured into 4 liters of water, weak-acidified with hydrochloric acid, and crystals thus formed were collected by filtration. The crude crystals thus obtained were dissolved in a mixture of ethyl acetate and ethanol and then hexane was added to the solution to deposit the crystals of (4-carboethoxyphenyl)thiosemicarbazide. The amount of the product thus obtained was 13.3 g and the yield was 55.6%.

A mixture of 13.2 g of (4-carboethoxyphenyl)thiosemicarbazide, 52.8 ml of ethyl orthoformate, and 3.3 g of acetic acid was stirred for 2 hours at 120° C. After cooling the mixture to room temperature, hexane was added to the mixture and crystals thus formed were collected by filtration and recrystallized from ethanol to provide 10.4 g of 1-(4-carboethoxyphenyl)-2-mercapto-1,3,4-triazole. The yield was 75.9% and the melting point was 194°-196° C.

To 8.2 g of 1-(4-carboethoxyphenyl)-2-mercapto-1,3,4-triazole was added 50 ml of an aqueous solution of 2 mol/liter of sodium hydroxide and the mixture was refluxed for 1 hour. Then, 100 ml of water was added to the reaction mixture and after filtering away insoluble matter, the pH of the filtrate was adjusted to about 1 by the addition of hydrochloric acid. Crystals thus formed were collected by filtration, dissolved in 500 ml of N,N-dimethylformamide and ethyl acetate and hexane were added to the solution, whereby 6.0 g of 1-(4-carboxyphenyl)-2-mercapto-1,3,4-triazole was obtained. The yield was 82.2% and the melting point was above 300° C.

To 4.3 g of 1-(4-carboxyphenyl)-2-mercapto-1,3,4-triazole was added 40 ml of N,N-dimethylacetamide and the mixture was cooled below 0° C. While maintaining the mixture below 0° C., 2.56 ml of isobutyl chloroformate and 2.7 ml of triethylamine were added to the mixture and then the mixture was stirred for 1 hour. Then, a solution of 2.9 g of 1-formyl-2-(4-aminophenyl)hydrazine in 10 ml of N,N-dimethylacetamide was added dropwise to the mixture and the resultant mixture was stirred for 30 minutes at a temperature below 0° C. and then for 2 hours at room temperature. Thereafter, 2 liters of water were added to the reaction mixture and crystals thus formed were collected by filtration and recrystallized twice from a mixture of N,N-dimethylformamide and methanol to provide 2.1 g of desired Compound 29. The yield was 30.5% and the melting point was 274°-275° C.

In the photographic material of this invention, it is preferred that the compound shown by general formula (I) is incorporated in surface latent image type silver halide emulsion layers and also the compound may be incorporated in a hydrophilic colloid layer adjacent to the surface latent image type silver halide emulsion layer. Such a hydrophilic colloid layer may be a subbing layer, an interlayer, a filter layer, a protective layer, an antihalation layer, etc., which does not disturb the diffusion of the compound of general formula (I) to silver halide grains.

The content of the compound shown by general formula (I) for use in this invention virtually depends upon the characteristics of the silver halide emulsions to be used, the chemical structure of the compound, and the development condition and hence can cover a wide range. A generally useful content of the compound is in the range of about $1\times10^{-6}$ mol to about $1\times10^{-3}$ mol, preferably about $4\times10^{-6}$ to about $1\times10^{-4}$ mol per mol of silver in a surface latent image type silver halide emulsion. That is, very high contrast photographic characteristics can be obtained by the use of the compound of formula (I) in an amount of about 1/10 to about 1/100 of the addition amount of a conventional hydrazine compound containing no adsorption group on silver halide grains.

There is no particular restriction about the silver halide which is used for photosensitive silver halide emulsion layers of the photographic material of this invention and silver chlorobromide, silver chloroiodobromide, silver iodobromide, silver bromide, etc., can be used. In the case of using silver iodobromide or silver chloroiodobromide, it is preferred that the content of silver iodide be in the range of less than 5 mol%.

There are also no restrictions on the form, crystal habit, grain size distribution, etc., of silver halide grains but silver halide grains having a grain size of less than 0.7 micron are preferred.

The silver halide emulsions for use in this invention can be sensitized without coarsening the silver halide grains by a gold compound such as a chloroaurate, gold trichlorate, etc., a salt of noble metal such as rhodium, iridium, etc., a sulfur compound capable of reacting with a silver salt to form silver sulfite, or a reducing material such as a stannous salt, an amine, etc.

Also, the physical ripening of silver halide grains or the formation of the nuclei can be performed in the presence of a salt of a noble metal such as rhodium, iridium, etc., or an iron compound such as a hexacyanoferrate, etc. In particular, the addition of a rhodium salt or a complex salt thereof is preferred since the addition thereof further increases the effect of this invention for attaining super high contrast photographic characteristics in a short developing time.

The surface latent image type silver halide emulsion for use in this invention means a silver halide emulsion containing silver halide grains having a surface sensitivity being higher than an inside sensitivity. As such a silver halide emulsion, the silver halide emulsion having a difference between the surface sensitivity and the inside sensitivity as defined in U.S. Pat. No. 4,224,401 is preferred.

Preferred amount of the surface latent image type silver halide emulsion used in the present invention is a silver coverage of 0.5 to 10 g/m$^2$ and particularly preferably 1 to 6 g/m$^2$.

The silver halide emulsion for use in this invention is preferably of a monodispersion type and the silver halide emulsion having a monodispersing property as defined in foregoing U.S. Pat. No. 4,224,401 is particularly preferred.

The photographic silver halide emulsions for use in this invention may be spectrally sensitized. The dyes which are used for the purpose include cyanine dyes, merocyanine dyes, complex cyanine dyes, complex merocyanine dyes, holopolar cyanine dyes, hemicyanine dyes, styryl dyes, and hemioxonol dyes, Cyanine dyes, merocyanine dyes, and complex merocyanine dyes are particularly preferred.

These sensitizing dyes may be used solely or as a combination of them. A combination of sensitizing dyes is frequently used for the purpose of super dye sensitization. The silver halide emulsion for use in this invention may further contain a dye which does not have a spectral sensitizing action by itself or a material which does not substantially absorb visible light and show super dye sensitizing action together with the foregoing sensitizing dye.

As a binder or a protective colloid which is used for the silver halide emulsion layers, interlayers, etc., of the photographic materials of this invention, gelatin is advantageously used but other protective colloids can be also used.

Examples of such hydrophilic colloids are gelatin derivatives; graft polymers of gelatin and other polymers; proteins such as albumin, casein, etc.; cellulose derivatives such as hydroxyethyl cellulose, carboxymethyl cellulose, cellulose sulfuric acid esters, etc.; sugar derivatives such as sodium alginate, starch derivatives, etc.; homopolymers or copolymers such as polyvinyl alcohol, polyvinyl alcohol partial acetal, poly-N-vinyppyrrolidone, polyacrylic acid, polymethacrylic acid, polyacrylamide, polyvinyl imidazole, polyvinyl pyrazole, etc.

As gelatin, limed gelatin as well as acid-treated gelatin and enzyme-treated gelatin as described in *Bull. Soc. Sci. Phot. Japan,* No. 16, p. 30 (1966) may be used and further a hydrolyzed product or an enzyme-decomposed product of gelatin can be used.

The photographic silver halide emulsions for use in this invention may further contain various compounds for preventing the formation of fog during the production, storage, photographic processings of photographic materials or stabilizing the photographic properties thereof. That is, there are various materials known as antifoggants or stabilizers, such as azoles (e.g., benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (in particular, 1-phenyl-5-mercaptotetrazole), etc.); mercaptopyrimidines; mercaptotriazines; thioketo compounds (e.g., oxazolinethione); azaindenes (e.g., triazaindenes, tetraazaindenes (in particular, 4-hydroxy-substituted (1,3,3a,7)tetraazaindenes), pentaazaindenes, etc.); benzenethiosulfonic acid; benzenesulfinic acid; benzenesulfonic acid amide; etc.

In these additives, benzotriazoles (e.g., 5-methylbenzotriazole) and nitroindazoles (e.g., 5-nitroindazole) are preferred. These additives may be incorporated in processing solutions.

The photographic materials of this invention may further contain inorganic or organic hardening agents in the photographic silver halide emulsion layers and other hydrophilic colloid layers. Examples of such hardening agents are chromium salts (e.g., chromium alum, chromium acetate, etc.), aldehydes (e.g., formaldehyde, glyoxal, glutaraldehyde, etc.), N-methylol compounds (e.g., dimethylolura, methyloldimethylhydantoin, etc.), dioxane derivatives (e.g., 2,3-dihydroxydioxane, etc.), active vinyl compounds (e.g., 1,3,5-triacrylol-hexahydro-s-triazine, 1,3-vinylsulfonyl-2-propanol, etc.), active halogen compounds (e.g., 2,4-dichloro-6-hydroxy-s-triazine, etc.), mucohalogenic acids (e.g., mucochloric acid, mucophenoxychloric acid, etc.), etc. They can be used solely or as a combination of them.

The photographic materials of this invention may further contain various surface active agents in the photographic silver halide emulsion layers or other hydrophilic colloid layers as coating aids and for various purposes such as static prevention, the improvement of sliding property, the improvement of emulsification, the prevention of adhesion, and the improvement of photographic properties (e.g., acceleration of development, increase of contrast, sensitization, etc.).

Examples of the surface active agents are nonionic surface active agents such as saponin (steroid series), alkylene oxide derivatives (e.g., polyethylene glycol, polyethylene glycol/polypropylene glycol condensation product, polyethylene glycol alkyl ethers, polyalkylene glycol alkylaryl ethers, polyethylene glycol esters, polyethylene glycol sorbitan esters, polyalkylene glycol alkylamines, polyalkylene glycol alkylamides, and polyethylene oxide addition products of silicone), glycidol derivatives (e.g., alkenylsuccinic acid polyglyceride, alkylphenol polyglyceride, etc.), fatty acid esters of polyhydric alcohols, alkyl esters of sugar, etc.; anionic surface active agents containing an acid group such as a carboxy group, a sulfo group, a phospho group, a sulfuric acid ester group, a phosphoric acid ester group, etc., such as alkylcarboxylates, alkylsulfonates, alkylbenzenesulfonates, alkylnaphthalenesulfonates, alkylsulfuric acid esters, alkylphosphoric acid esters, N-acyl-N-alkyltaurines, sulfosuccinic acid esters, sulfoalkyl polyoxyethylenealkylphenyl ether, polyoxyethylenealkylphosphoric acid esters, etc.; amphoteric surface active agents such as amino acids, aminoalkylsulfonic acid, aminoalkylsulfuric acid esters, aminoalkylphosphoric acid esters, alkylbetaines, amine oxides, etc.; and cationic surface active agents such as alkylamine salts; aliphatic or aromatic quaternary ammonium salts; heterocyclic quaternary ammonium salts such as pyridinium, imidazolium, etc., phosphonium or sulfonium salts containing aliphatic rings or heterocyclic rings.

When polyalkylene oxides are used in this invention, the polyalkylene oxides having a molecular weight of higher than 600 described in Japanese Patent Publication No. 9412/83 are preferred.

The photographic materials of this invention may further contain dispersions of water-insoluble or sparingly soluble synthetic polymers in the photographic silver halide emulsion layers or other hydrophilic colloid layers for improving the dimensional stability thereof. Examples of the synthetic polymers are polymers of alkyl (meth)acrylate, alkoxyalkyl (meth)acrylate, glycidyl (meth)acrylate, (meth)acrylamide, vinyl esters (e.g., vinyl acetate), acrylonitrile, olefin, styrene, etc., solely or a combination thereof or a combination of the foregoing monomer and acrylic acid, methacrylic acid, $\alpha,\beta$-unsaturated dicarboxylic acid, hydroxyalkyl (meth)acrylate, sulfoalkyl (meth)acrylate, styrenesulfonic acid, etc.

For image exposure of the silver halide photographic materials of this invention visible light is mainly used, and further actinic rays other than visible light, in particular, ultraviolet rays may be used.

For obtaining super high contrast photographic characteristics using the silver halide photographic materials of this invention, a stable developer can be used without need of using a conventional infectious developer or a high alkali developer having a pH near 13 described in U.S. Pat. No. 2,419,975.

That is, for the silver halide photographic materials of this invention, a developer containing a sufficient amount (in particular, higher than 0.15 mol/l) of a sulfite ion as a precursor can be used and also super high contrast negative images can be obtained by using a developer having a pH of higher than 9.5, in particular pH of 10.5 to 12.3.

There is no particular restriction about a developing agent for developing the photographic materials of this invention. For example, dihydroxybenzenes (e.g., hydroquinone), 3-pyrazolidones (e.g., 1-phenyl-3-pyrazolidone, 4,4-dimethyl-1-phenyl-3-pyrazolidone, etc.), aminophenols (e.g., N-methyl-p-aminophenol), etc., can be used solely or in combination.

The silver halide photographic materials of this invention are particularly suitable for processing with a developer containing a dihydroxybenzene as a developing agent and a 3-pyrazolidone as an auxiliary developing agent.

The developer which is used for processing the photographic materials of this invention may further contain a pH buffer such as a sulfite, a carbonate, a borate, or a phosphate of an alkali metal; a development inhibitor such as a bromide, an iodide, etc., and organic antifoggants (particularly preferably a nitroindazole or a benzotriazole); and an antifoggant. Also, if necessary, the developer may contain a water softener, a dissolution aid, a color toning agent, a development accelerator, a surface active agent (particularly, the foregoing polyalkylene oxides), a defoaming agent, a hardening agent, a silver stain preventing agent for photographic films (e.g., a 2-mercaptobenzimidazole sulfonic acids), etc.

Practical examples of these additives are described in *Research Disclosure,* No. 176, 17643, etc.

As a fix solution for processing the photographic materials of this invention, the composition generally used as a fix soltuion can be used. As the fixing agent, thiosulfates, thiocyanates, as well as organic sulfur copounds which are known to have an effect as a fixing agent can be used. Also, the fix solution may further contain a water-soluble aluminum salt as a hardening agent.

For processing the photographic materials of this invention, a system of processing with an alkaline activator solution using the photographic material containing therein a developing agent may be employed (see, Japanese Patent Application (OPI) Nos. 129436/82, 129433/82, 129434/82, 129435/82, U.S. Pat. No. 4,323,643, etc.).

The processing temperature is usually selected in the range of 18° C. to 50° C. but a temperature lower than 18° C. or a temperature higher than 50° C. may be employed as the case may be.

It is preferred to use an automatic processor for the photographic processings of the photographic materials of this invention. In this invention, even when the total processing time for the whole processing of the photographic material in the automatic processor is established as 90 seconds to 120 seconds, sufficiently high contrast negative gradation photographic characteristics are obtained.

The following examples are intended to illustrate the invention but not to limit it in any way.

Unless otherwise specified, all ratios, percents, etc., are by weight.

EXAMPLE 1

A monodispersed silver iodobromide emulsion of cubic crystal having a silver halide grain size of 0.30 μm and containing 2.0 mol% of iodide was prepared (Emulsion A). The emulsion was washed with water according to an ordinary manner to remove soluble salts and chemically sensitized by the additon of sodium thio sulfate and potassium chloroaurate. The emulsion contained gelatin as gelatin/$AgNO_3$ (weight ratio) of 0.30/1.

Emulsion A was split into 20 parts. After adding anhydro-5,5'-dichloro-9-ethyl-3,3'-bis(3-sulfopropyl)oxacarbocyanine hydroxide-sodium salt as a sensitizing dye and further a dispersion of 4-hydroxy-6-methyl-1,3,3a,7-tetraazaindene and polyethyl acrylate to each part of the emulsion, each of the compounds of general formula (I) of this invention and Compounds A and B other than the compounds of this invention in an amount shown in Table 1 and a hardening agent (2-hydroxy-4,6-dichloro-1,3,5-triazine sodium salt) were added to each part of the emulsion and the emulsion was coated on a polyethylene terephthalate film at a silver coverage of 3.6 g/m$^2$. Furthermore, a gelatin solution was simultaneously coated on the emulsion layer as a protective layer at a gelatin coverage of 0.8 g/m$^2$. Thus, films No. 1 to No. 20 were prepared as photographic film samples.

The Comparison Compounds A and B used for the above comparison samples are as follows.

Compound A

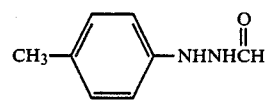

Compound B

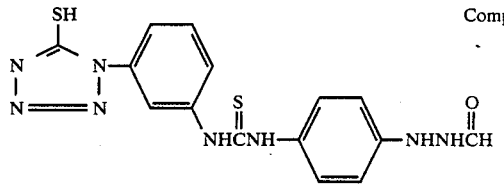

Each of these films was exposed through a sensitometric exposure wedge using a 150 line gray contact screen, developed by the developer haivng the following composition for 30 seconds at 38° C., stopped, fixed, washed and dried.

| Developer: | |
|---|---|
| Hydroquinone | 40.0 g |
| 4,4'-Dimethyl-1-phenyl-3-pyrazolidone | 0.4 g |
| Sodium Hydroxide | 13.0 g |
| Anhydrous Potassium Sulfite | 90.0 g |
| Potassium Tertiary Phosphate | 74.0 g |
| Ethylenediaminetetraacetic Acid Disodium Salt | 1.0 g |
| Potassium Bromide | 6.0 g |
| 5-Methylbenzotriazole | 0.6 g |
| 1-Diethylamino-2,3-dihydroxypropane | 17.0 g |
| Water to make | 1 liter |
| pH adjusted to 11 by sodium hydroxide | |

The photographic properties of each sample thus processed were measured and the results are shown in Table 1.

TABLE 1

| Film No. | Additive Compound | Additive Amount* | Sensitivity (relative exposure amount for giving 1/D = 2.0) | Gamma (mean gradient of density from 0.3 to 3.0) | Dot Quality** | After 30 Days at 35° C., 65% Sensitivity*** | After 30 Days at 35° C., 65% Fog*** |
|---|---|---|---|---|---|---|---|
| 1 | — | — | 25% | 4.0 | 1 | ±0% | ±0 |
| 2 | Compound A | $4.5 \times 10^{-6}$ | 25 | 4.1 | 1 | ±0 | ±0 |
| 3 | " | $4.5 \times 10^{-5}$ | 30 | 4.5 | 1 | ±0 | ±0 |
| 4 | " | $4.5 \times 10^{-4}$ | 48 | 4.9 | 1 | ±0 | ±0 |
| 5 | " | $1.1 \times 10^{-3}$ | 80 | 11 | 3 | +3 | +0.01 |
| 6 | " | $2.2 \times 10^{-3}$ | 100 | 14 | 4 | +1 | +0.06 |
| 7 | " | $4.5 \times 10^{-3}$ | 135 | 19 | 4.5 | +40 | +0.15 |
| 8 | " | $9.0 \times 10^{-3}$ | 180 | 18 | 4.5 | +80 | +0.33 |
| 9 | Compound B | $4.5 \times 10^{-6}$ | 35 | 10 | 3 | −15 | ±0 |
| 10 | " | $1.1 \times 10^{-5}$ | 55 | 12.5 | 3.5 | −25 | ±0 |
| 11 | " | $2.2 \times 10^{-5}$ | 120 | 16 | 4.5 | −40 | ±0 |
| 12 | " | $4.5 \times 10^{-5}$ | 180 | 18 | 4.5 | −45 | −0.01 |
| 13 | Compound 2 | $4.5 \times 10^{-6}$ | 80 | 14 | 4 | ±0 | ±0 |
| 14 | " | $1.1 \times 10^{-5}$ | 125 | 17 | 4.5 | ±0 | ±0 |
| 15 | " | $2.2 \times 10^{-5}$ | 180% | 19 | 5 | +3% | +0.01 |
| 16 | " | $4.5 \times 10^{-5}$ | 250 | 20 | 5 | +5 | +0.01 |
| 17 | Compound 1 | $4.5 \times 10^{-6}$ | 100 | 15 | 4.5 | ±0 | ±0 |
| 18 | " | $1.1 \times 10^{-5}$ | 135 | 19 | 5 | ±0 | ±0 |
| 19 | " | $2.2 \times 10^{-5}$ | 190 | 20 | 5 | +2 | ±0 |
| 20 | " | $4.5 \times 10^{-5}$ | 285 | 20 | 5 | +5 | +0.01 |

Sample No. 1 to 12: Comparison examples, Sample Nos. 13 to 20: Samples of this invention

*The addition amount shown by mol number per mol of silver

**Dot quality visually evaluated in 5 stages, wherein stage 5 stands for the best quality and stage 1 for the worst quality. Qualities of 5 and 4 can be practically used as dot image negatives for making printing plates, the quality of 3 may sometimes be used, but qualities of 2 and 1 are unsuitable for practical use.

***The sensitivity and fog after storing for 30 days at relative humidity of 65% compared with those after 7 days since coating (stored at relative humidity of 55% and at 25° C.). The sensitivity was shown by percentage of the sensitivity difference between the sensitivity just after coating and the sensitivity after 30 days (35° C., 65% RH); and the fog was shown by the difference in density values. The allowable width for the practical use as a negative for making printing plates is ±10% in sensitivity and ±0.02 in fog.

From the results shown in Table 1, it can be seen that the samples (No. 13 to No. 20) containing Compounds 1 and 2 of this invention give good dot qualities with high sensitivity and have high contrast as compared to the samples (No. 2 to No. 8) containing Compound A other than the compound of this invention even when the addition amount of Compounds 1 and 2 is 1/10 or less than 1/10 of the amount of the comparison compound, and also Sample Nos. 13 to 20 show good stability with the passage of time, while sample Nos. 2 and 8 cause an increase of fog with the passage of time. Also, by comparing the samples (No. 13 to No. 20) containing Compounds 1 and 2 of this invention with the samples (No. 9 to No. 12) containing Compound B other than the compound of this invention, Sample Nos. 13 to 20 show good stability with the passage of time, while Sample Nos. 9 to 12 cause desensitization with the passage of time although the addition amount of Compound B for improving the sensitivity, the contrast, and the dot quality is small as the case of using Compound 1 or 2 of this invention.

EXAMPLE 2

A monodispersed silver chloroiodobromide emulsion having a grain size of 0.30 μm and containing 30 mol% Br, 0.1 mol% I, and $2.7 \times 10^{-7}$ mol/mol-Ag of rhodium was prepared (Emulsion B). The emulsion was washed with water to remove soluble salts and then chemically sensitized by the addition of sodium thiosulfate and potassium chloroaurate.

Then, by following the same procedure as Example 1 except that potassium 4-[5-chloro-2-[[1-[2-(2-hydroxyethoxy)ethyl]-3-(2-pyridyl)-2-thiohydantoin-5-iridene]ethylidene]benzoxazolin-1-yl]butane sulfonate was used in place of the sensitizing dye used in Example 1, Sample Nos. 21 to 36 were prepared as photographic film samples.

Each of the samples was exposed, processed, tested and evaluated by the same manner as in Example 1 and the results are shown in Table 2.

TABLE 2

| Film No. | Additive Compound | Additive Amount* | Sensitivity (relative exposure amount for giving 1/D = 2.0) (%) | Gamma (mean gradient of density from 0.3 to 3.0) | Dot Quality** | After 30 Days at 35° C., 65% Sensitivity*** (%) | After 30 Days at 35° C., 65% Fog*** |
|---|---|---|---|---|---|---|---|
| 21 | — | — | 25 | 6.3 | 1 | ±0 | ±0 |
| 22 | 1-Formyl-2-p-tolyl-hydrazine | $4.5 \times 10^{-6}$ | 30 | 6.3 | 1 | ±0 | ±0 |
| 23 | 1-Formyl-2-p-tolyl-hydrazine | $4.5 \times 10^{-5}$ | 35 | 6.4 | 1 | ±0 | ±0 |
| 24 | 1-Formyl-2-p-tolyl-hydrazine | $4.5 \times 10^{-4}$ | 55 | 7.0 | 1 | ±0 | ±0 |
| 25 | 1-Formyl-2-p-tolyl-hydrazine | $1.1 \times 10^{-3}$ | 84 | 12 | 3 | +3 | +0.01 |

TABLE 2-continued

| Film No. | Additive Compound | Additive Amount* | Sensitivity (relative exposure amount for giving 1/D = 2.0) (%) | Gamma (mean gradient of density from 0.3 to 3.0) | Dot Quality** | After 30 Days at 35° C., 65% Sensitivity*** (%) | After 30 Days at 35° C., 65% Fog*** |
|---|---|---|---|---|---|---|---|
| 26 | 1-Formyl-2-p-tolyl-hydrazine | $2.2 \times 10^{-3}$ | 99 | 13 | 4 | +18 | +0.06 |
| 27 | 1-Formyl-2-p-tolyl-hydrazine | $4.5 \times 10^{-3}$ | 138 | 17 | 4.5 | +43 | +0.16 |
| 28 | 1-Formyl-2-p-tolyl-hydrazine | $9.0 \times 10^{-3}$ | 181 | 18 | 4.5 | +86 | +0.35 |
| 29 | Compound 2 | $4.5 \times 10^{-6}$ | 79 | 13 | 4 | ±0 | ±0 |
| 30 | " | $1.1 \times 10^{-5}$ | 124 | 17 | 4.5 | ±0 | ±0 |
| 31 | " | $2.2 \times 10^{-5}$ | 181 | 18 | 5 | +3 | +0.01 |
| 32 | " | $4.5 \times 10^{-5}$ | 252 | 19 | 5 | +5 | +0.01 |
| 33 | Compound 3 | $4.5 \times 10^{-6}$ | 104 | 16 | 4.5 | ±0 | ±0 |
| 34 | " | $1.1 \times 10^{-5}$ | 136 | 17 | 5 | ±0 | ±0 |
| 35 | " | $2.2 \times 10^{-5}$ | 194 | 21 | 5 | +2 | ±0 |
| 36 | " | $4.5 \times 10^{-5}$ | 284 | 20 | 5 | +5 | +0.01 |

Film No. 21 to 28: Comparison samples, Film Nos. 29 to 36: Samples of this invention In Table 2, the addition amount, the dot quality, the sensitivity and the fog have the same meaning as defined in Table 1.

From the results shown in Table 2, it can be seen that the samples containing the compounds of this invention give very good dot quality with high sensitivity and having high contrast as compared with the comparison samples, the compound of this invention gives the good effect in an amount of 1/10 or less than 1/10 of the comparison compound (Film Nos. 22 to 28), and also the samples of this invention show good stability with the passage of time.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having at least one silver halide emulsion layer containing substantially surface latent image silver halide grains, said emulsion layer or at least one hydrophilic colloid layer adjacent to the emulsion layer containing a compound represented by general formula (III):

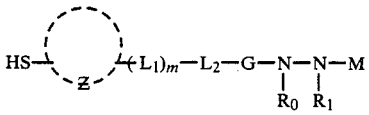

(III)

wherein Z represents an atomic group necessary for forming a monocyclic or condensed heterocyclic ring composed of a carbon atom or carbon atoms and a nitrogen atom or nitrogen atoms; $L_1$ represents a divalent organic group selected from the group consisting of:

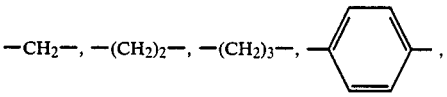

-continued

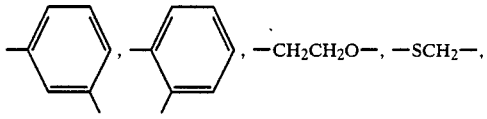

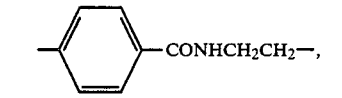

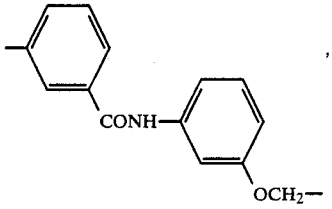

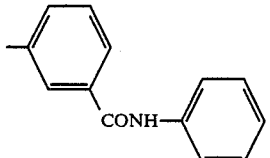

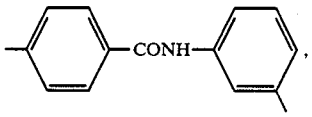

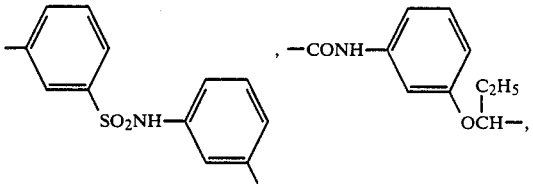

-continued

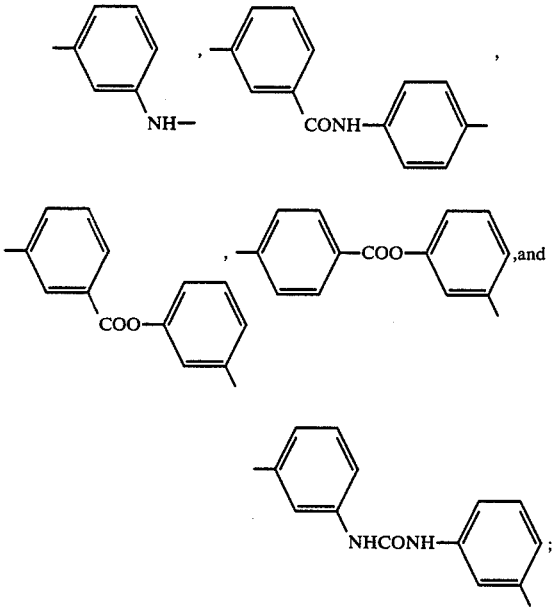

m represents 0 or 1; G represents phenylene or naphthylene which may have one or more substituents; M represents a formyl group; $R_0$ represents a hydrogen atom; and $L_2$ represents —CONR—, —$SO_2$NR— or —NR-CONR'—, wherein R and R' each represents a hydrogen atom, an alkyl group or an aryl group; $R_1$ represents a hydrogen atom, said M, $R_1$ and the nitrogen atom to which M and $R_1$ attach may form a partial structure

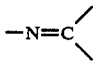

of hydrazone.

2. The silver halide photographic material as claimed in claim 1, wherein the compound shown by general formula (III) is the compound represented by general formula (V):

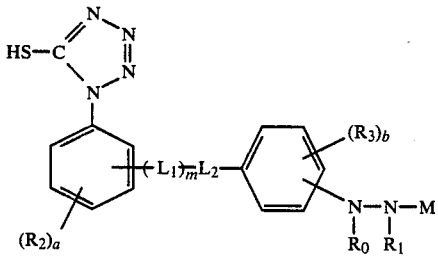

(V)

wherein $L_1$, $L_2$, m, $R_0$, $R_1$, and M have the same significance as defined in regard to general formula (III) and $R_2$ and $R_3$ each represents a hydrogen atom, an alkyl group, an alkoxy group, a carbonamido group, a sulfonamido group, or a halogen atom; and a and b are each 0 to 4.

3. A silver halide photographic material as claimed in claim 1, wherein $R_1$ in the general formula (III) represents a hydrogen atom or forms a partial structure

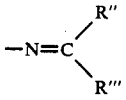

of hydrazone with M and the nitrogen atom to which $R^1$ and M attach; wherein R'' represents an alkyl group, an aryl group or a heterocyclic group and R''' represents a hydrogen atom, an alkyl group, an aryl group or a heterocyclic group.

4. A silver halide photographic material as claimed in claim 1, wherein $R_1$ in the general formula (III) represents a hydrogen atom or forms a partial structure

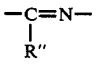

of hydrazone with $L_2$ and the nitrogen atom to which $R_1$ and $L_2$ attach; wherein R'' represents an alkyl group, an aryl group or a heterocyclic group.

5. A silver halide photographic material as claimed in claim 1, wherein the amount of the compound represented by the general formula (III) is $1\times10^{-6}$ to $1\times10^{-3}$ mol per mol of silver in the surface latent image type silver halide emulsion.

6. The silver halide photographic material as claimed in claim 1, wherein Z represents a heterocyclic ring selected from the group consisting of pyrrole, pyrazole, imidazole, triazole, tetrazole, pyridine, pyrimidine, pyrazine, pyridazine, triazine, indazole, benzimidazole and azaindene.

7. The silver halide photographic material as claimed in claim 1, wherein Z represents a heterocyclic ring selected form the group consisting of triazole, tetrazole, imidazole and benzimidazole.

8. The silver halide photographic material as claimed in claim 1, wherein $L_1$ represents a member selected from the group consisting of $-(CH_2)_2-$ or $-(CH_2)_3-$.

9. The silver halide photographic material as claimed in claim 1, wherein G is substituted with a member selected from the group consisting of an alkyl group, a halogen atom, an alkoxy group, a carbonamido group and a sulfonamido group.

10. The silver halide photographic material as claimed in claim 1, wherein $L_2$ is —CONR—.

11. The silver halide photographic material as claimed in claim 1, wherein R and R' are selected from the group consisting of a hydrogen atom, a methyl group, an ethyl group and a phenyl group.

12. The silver halide photographic material as claimed in claim 1, wherein R and R' are hydrogen alone.

* * * * *